US007497566B2

(12) United States Patent
Park et al.

(10) Patent No.: US 7,497,566 B2
(45) Date of Patent: Mar. 3, 2009

(54) IMAGE TRANSFER ELEMENT WITH BALANCED CONSTANT LOAD FORCE

(75) Inventors: Daniel C. Park, West Linn, OR (US); Donald B. Maclane, Portland, OR (US); Richard G. Chambers, Portland, OR (US); Timothy L. Crawford, Saint Paul, OR (US); Darrell R. Finneman, Albany, OR (US); William Y. Pong, Bakersfield, CA (US)

(73) Assignee: Xerox Corporation, Norwalk, CT (US)

( * ) Notice: Subject to any disclaimer, the term of this patent is extended or adjusted under 35 U.S.C. 154(b) by 416 days.

(21) Appl. No.: 10/843,855

(22) Filed: May 12, 2004

(65) Prior Publication Data

US 2005/0150397 A1 Jul. 14, 2005

Related U.S. Application Data

(60) Provisional application No. 60/535,855, filed on Jan. 12, 2004.

(51) Int. Cl.
*B41J 2/01* (2006.01)

(52) U.S. Cl. ..... 347/103; 347/104

(58) Field of Classification Search ..... 347/103, 347/104

See application file for complete search history.

(56) References Cited

U.S. PATENT DOCUMENTS 1,962,130 A * 6/1934 Berkey ..... 254/384
1,972,025 A * 8/1934 Matton ..... 139/337
2,208,064 A * 7/1940 Wood ..... 248/543
2,226,637 A * 12/1940 Richard ..... 172/482
2,554,312 A * 5/1951 Price ..... 74/96
2,615,708 A * 10/1952 Rouverol ..... 267/173
2,709,057 A * 5/1955 Gould ..... 248/543
2,898,083 A * 8/1959 Kresl ..... 254/273

(Continued)

FOREIGN PATENT DOCUMENTS

GB 2138101 A * 10/1984

OTHER PUBLICATIONS

Co-pending U.S. Appl. No. 60/535,857, filed Jan. 12, 2004, entitled "Image Transfer Element with Leverage," by Park et al.

*Primary Examiner*—Stephen D Meier
*Assistant Examiner*—Leonard S Liang
(74) *Attorney, Agent, or Firm*—Maginot, Moore & Beck LLP

(57) ABSTRACT

An image transfer mechanism includes a pressure element and a lever system. The lever system has a load attachment point with a range of position that depends on the thickness of a print medium positioned between the imaging element and the pressure element. A load mechanism includes a load connector with a distal end attached to the lever system load attachment point so that displacement of the lever system attachment point causes longitudinal movement of the load connector. The load mechanism applies a load that is substantially constant throughout the range of position of the lever system load attachment point. The load mechanism includes a spring and a crank attached to the spring and to the proximal end of the load connector. The crank is configured so that a change in the spring force produces a lesser change in the load force at the distal end of the load connector.

19 Claims, 8 Drawing Sheets

U.S. PATENT DOCUMENTS 2,924,411 A * 2/1960 Rouverol ..... 248/572
3,109,676 A * 11/1963 Mercer ..... 294/82.31
4,206,898 A * 6/1980 Salter ..... 248/561
5,415,055 A * 5/1995 Henfrey ..... 74/96
6,536,896 B1 * 3/2003 Kan ..... 347/104

* cited by examiner

IMAGE TRANSFER ELEMENT WITH BALANCED CONSTANT LOAD FORCE

This application claims the benefit of Provisional Patent Application No. 60/535,855, filed Jan. 12, 2004.

BACKGROUND AND SUMMARY

In various printing technologies, marking material is applied to the surface of an intermediate imaging element, such as a belt or a drum. The print media to which the image is ultimately to be applied (such as paper) is then pressed against the intermediate imaging element to transfer the image from the intermediate imaging element to the print media. In one example using electrostatographic or xerographic printing, an image of ink liquid or dry toner) is formed on an electrically charged image receptor. The print media is pressed against the image receptor to transfer the image to the print media. The image is subsequently fused to the print media by applying pressure with a fuser roller. In another example using phase change ink jet printing, ink is deposited to form an image on the surface of an imaging drum. A transfix roller presses the print media against the image-bearing drum surface to transfer the ink image from the drum surface to the print media and fuse the ink image to the print media.

In many circumstances, it is desirable for the pressure applied to be constant, regardless of the thickness of the print medium. Therefore, displacement of the pressure applicator due to different thicknesses of print medium should not materially change the magnitude of the pressure applied. Furthermore, it is often desirable that the pressure applied be balanced across the width of the print medium.

In accordance with one aspect of the present invention, an image transfer mechanism for pressing a print medium against an imaging element includes a pressure element and a lever system for pressing the pressure element toward the imaging element. The lever system has a load attachment point that has a range of position that depends on the thickness of a print medium positioned between the imaging element and the pressure element. A load mechanism includes a load connector with a proximal end and a distal end, with the distal end attached to the load attachment point of the lever system so that displacement of the lever system attachment point causes longitudinal movement of the load connector. The load mechanism applies at the lever system load attachment point a load that is substantially constant throughout the range of position of the lever system load attachment point. The load mechanism includes a spring and a crank attached to the spring and to the proximal end of the load connector so that longitudinal movement of the load connector causes a change in the length of the spring. The crank geometry is configured so that a change in the spring force due to longitudinal movement of the load connector produces a lesser change in a load force at the distal end of the load connector than the change in the force of the spring due to the change in spring length.

Another aspect of the present invention includes a load mechanism for applying a load force, with the load mechanism including a crank having a crank pivot, a spring attached to the crank at a spring attachment, and a load connector attached to the crank at a load connector attachment. The spring attachment and the load connector attachment are separated by an attachment angle relative to the crank pivot, and the spring has a spring direction of action relative to the crank. The spring direction of action has a spring effective radius extending perpendicular to the spring direction of action from the crank pivot to the spring direction of action, while the load connector has a load direction of action relative to the crank. The load connector direction of action has an load connector effective radius extending perpendicular to the load connector direction of action from the crank pivot to the load connector direction of action, and the spring effective radius and the load connector effective radius are separated by an action separation angle. The action separation angle is different from the attachment angle.

In yet another aspect, the present invention includes a load mechanism for applying a load force, with the load mechanism including a crank having a crank pivot, a spring attached to the crank at a spring attachment, and a load connector attached to the crank at a load connector attachment. The spring attachment and the load connector attachment are separated by an attachment angle relative to the crank pivot, and the spring has a spring direction of action relative to the crank. The spring direction of action has a spring effective radius extending perpendicular to the spring direction of action from the crank pivot to the spring direction of action, while the load connector has a load direction of action relative to the crank. The load connector direction of action has an load connector effective radius extending perpendicular to the load connector direction of action from the crank pivot to the load connector direction of action, and the spring effective radius and the load connector effective radius are separated by an action separation angle. As the crank rotates in a first rotational direction, the length of the load connector effective radius and the length of the spring effective radius change at different rates.

DETAILED DESCRIPTION

Figure 1:
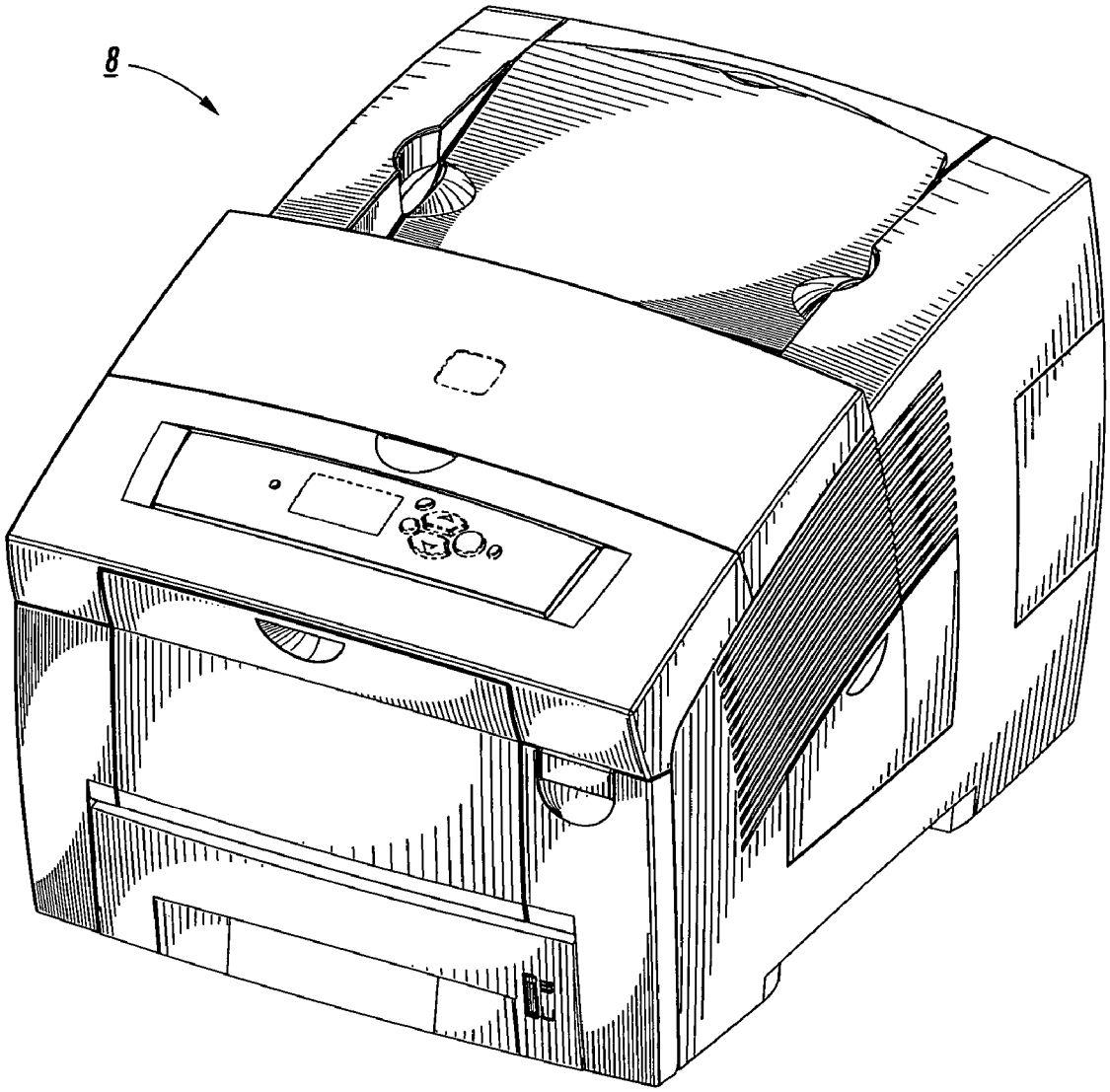
FIG. 1 is a perspective view of an exemplary phase change ink jet printer incorporating an embodiment of the present invention.

A printer 8 (FIG. 1) includes a housing or shell that encloses a print mechanism (not shown). The present description references a phase change ink jet print mechanism. However, persons familiar with printing technologies will recognize that the print mechanism may also encompass a xerographic or other electrostatic print mechanism.

In a phase change inkjet printer, ink is typically delivered to the printer in a solid form. An ink delivery mechanism melts the ink to a liquid form, and delivers the liquid ink to an inkjet printhead. The inkjet printhead ejects drops of the liquid ink from a multitude of inkjet nozzles onto an imaging element, typically an oil-coated drum. After the printhead forms the image on the surface of the imaging element, a transfix mechanism causes the image to be transferred from the imaging element to a print medium, such as paper, card stock, transparency, vinyl, etc. In certain implementations, this transfer process is called transfix because the image is simultaneously transferred and bonded (or fixed) to the print medium. The present description refers to a transfix mechanism that simultaneously transfers and bonds the image to the print medium. However, the principles, structures, and methods described are applicable to a variety of mechanisms in which a uniform, regulated pressure is to be applied, including different types of transfer and fusing rollers.

Figure 2:
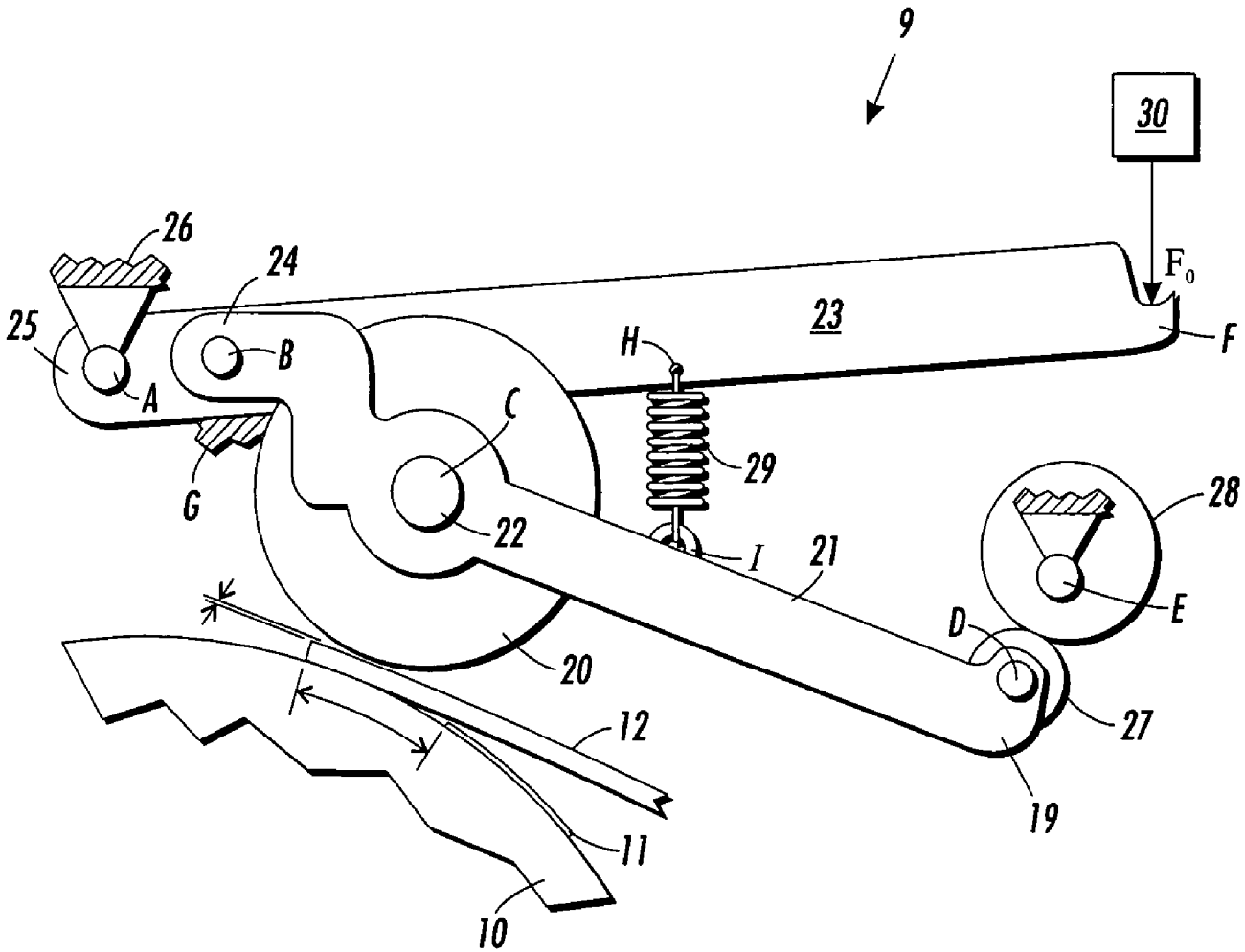
FIG. 2 is a view, partially in cross section, of a transfix roller incorporating an embodiment of an aspect of the present invention.

Referring to FIG. 2, an exemplary image transfer or transfix mechanism 9 includes an imaging drum 10 on which an image 11 has been formed, and a transfer element, such as a transfix roller 20, used to apply pressure to media 12 interposed between the drum 10 and the roller 20. FIG. 2 is an end view of the transfix mechanism. The imaging drum has a width extending substantially parallel to the axis 22 of the transfix roller 20. The transfix roller extends across the width of the imaging drum. Another transfix mechanism, which may be identical to the one shown in FIG. 2, is positioned at the opposite side of the imaging drum.

Pressure applied by the transfix roller 20 enhances transfer of the image 11 from the drum 10 to the media 12. The transfix roller is pressed toward the imaging drum 10 by a transfix lever assembly that includes a roller arm 21. The proximal end 24 of the roller arm 21 is attached to the load arm 23 at an arm pivot B. The transfix roller 20 has an axis 22 fixed to the roller arm 21 at roller pivot C. The proximal end 25 of the load arm 23 is connected to a frame 26 of the printer via a frame pivot connection A. The second, distal, end 19 of the roller arm 21 includes an engaging mechanism to cause the roller arm to selectively move toward the imaging drum for the transfix operation. In an embodiment, the engaging mechanism is a transfix cam follower 27 that rotates on cam follower pivot D and is engaged by a transfix cam 28.

As shown in FIG. 2, the transfix mechanism is in a disengaged position. The load arm 23 rests at fixed stop G on a fixed portion of the printer frame. A load mechanism 30 applies a load force $F_0$ at a load attachment at the distal end F of the load arm 23 to hold the load arm against the fixed stop G. A roller bias spring 29 is connected between a load arm bias connection point H on the load arm 23 and a roller arm bias connection point I on the roller arm 21. This roller bias spring holds the roller arm in position with the cam follower 27 against the transfix cam 28, so that the transfix roller 20 is separated from the surface of the imaging drum 10 and the media 12. In an alternative, the roller bias spring may be connected between the roller arm bias connection point I and a fixed portion of the printer frame. The bias force provided by the roller bias spring 29 may be only a small fraction of the load force $F_0$.

Figure 3:
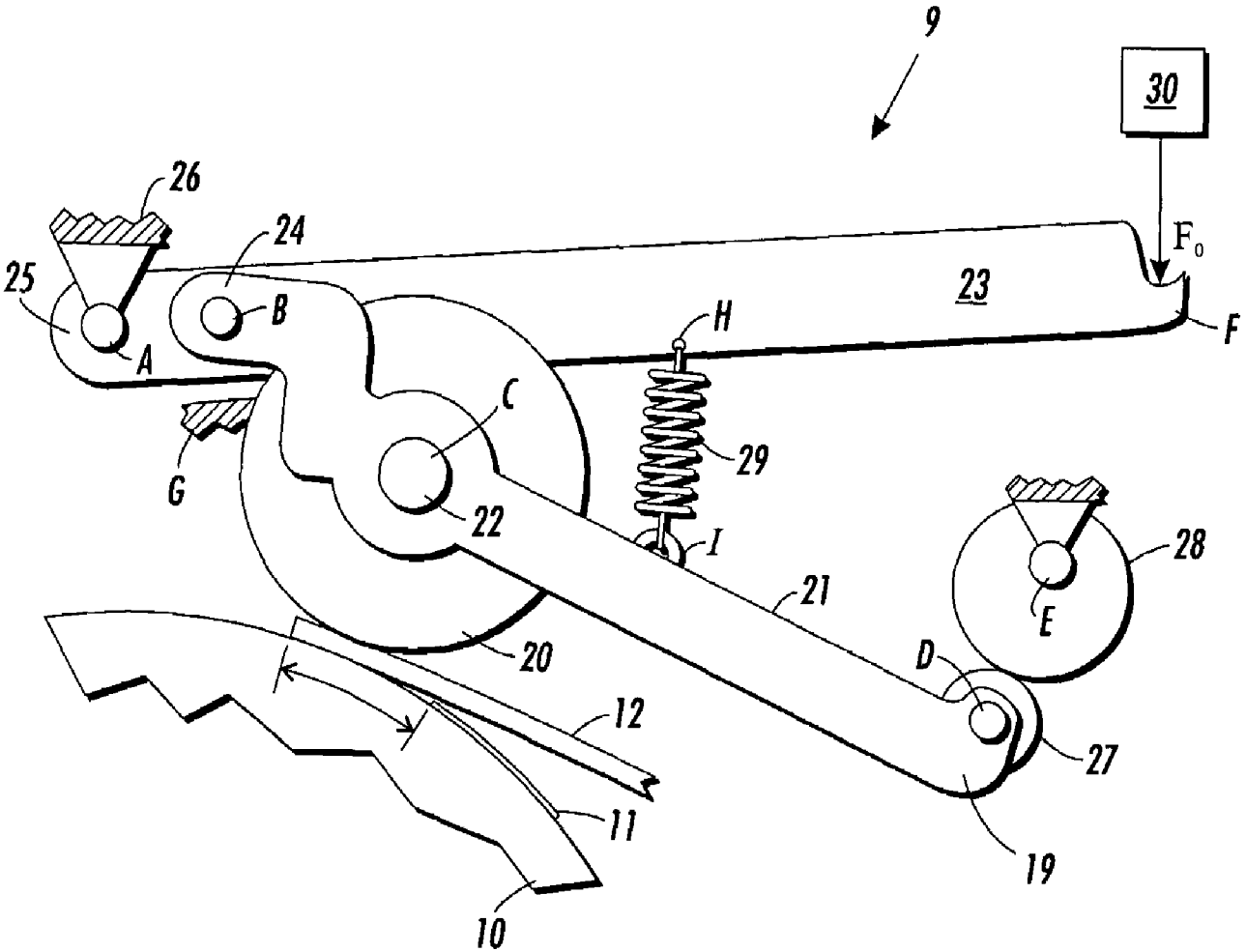
FIG. 3 is a view, partially in cross section, of the transfix roller of FIG. 2, showing the transfix roller engaged with a print medium on the imaging drum.

FIG. 3 shows the exemplary transfix mechanism in an engaged position, applying a transfix pressure to press the media 12 against the surface of the imaging drum. Such pressure will cause the image 11 to be transferred and fixed to the media 12 as the imaging drum rotates. To engage the transfix mechanism, the transfix cam 28 is rotated about pivot E so that the cam 28 engages the cam follower 27 to cause the distal end 19 of the roller arm 21 to move toward the imaging drum. So moving the roller arm initially causes the roller arm to rotate about its proximal end 24 at the pivot B until the transfix roller 20 engages the media 12. Once the transfix roller has engaged the media, and the transfix cam 28 continues to rotate to press against the roller arm, the roller arm rotates about pivot C, which is the axis 22 of the transfix roller 20. To the extent that the transfix roller 20 deforms under pressure, there may be some additional rotation about arm pivot B. The proximal end of the roller arm then presses against the load arm, lifting the load arm against the load force $F_0$ applied by the load mechanism 30, and rotating the load arm about a load arm pivot A. The arrangement of the transfix mechanism leverages the load force $F_0$ so that the force of the transfix roller 20 against the media on the imaging drum is much larger than the load force on the distal end of the load arm. In an example, the load force $F_0$ at the end of the load arm may be approximately 30 pounds. With the leverage provided by the arrangement of the transfix mechanism on each end of the transfix roller, the transfix roller can apply approximately 550-600 pounds of force to press the media against the surface of the imaging drum.

A constant load force $F_0$ ensures that the transfix pressure against the media 12 is constant. Media 12 of different thicknesses will cause the distal end F of the load arm 23 to assume a position within a range of position when the transfix mechanism is engaged. The deflection of the load attachment point at the distal end of the load arm 23 thus depends on the thickness of the media 12. Ideally, the load force $F_0$ applied to the distal end F of the load arm 23 should not change as the amount of deflection changes.

Figure 4:
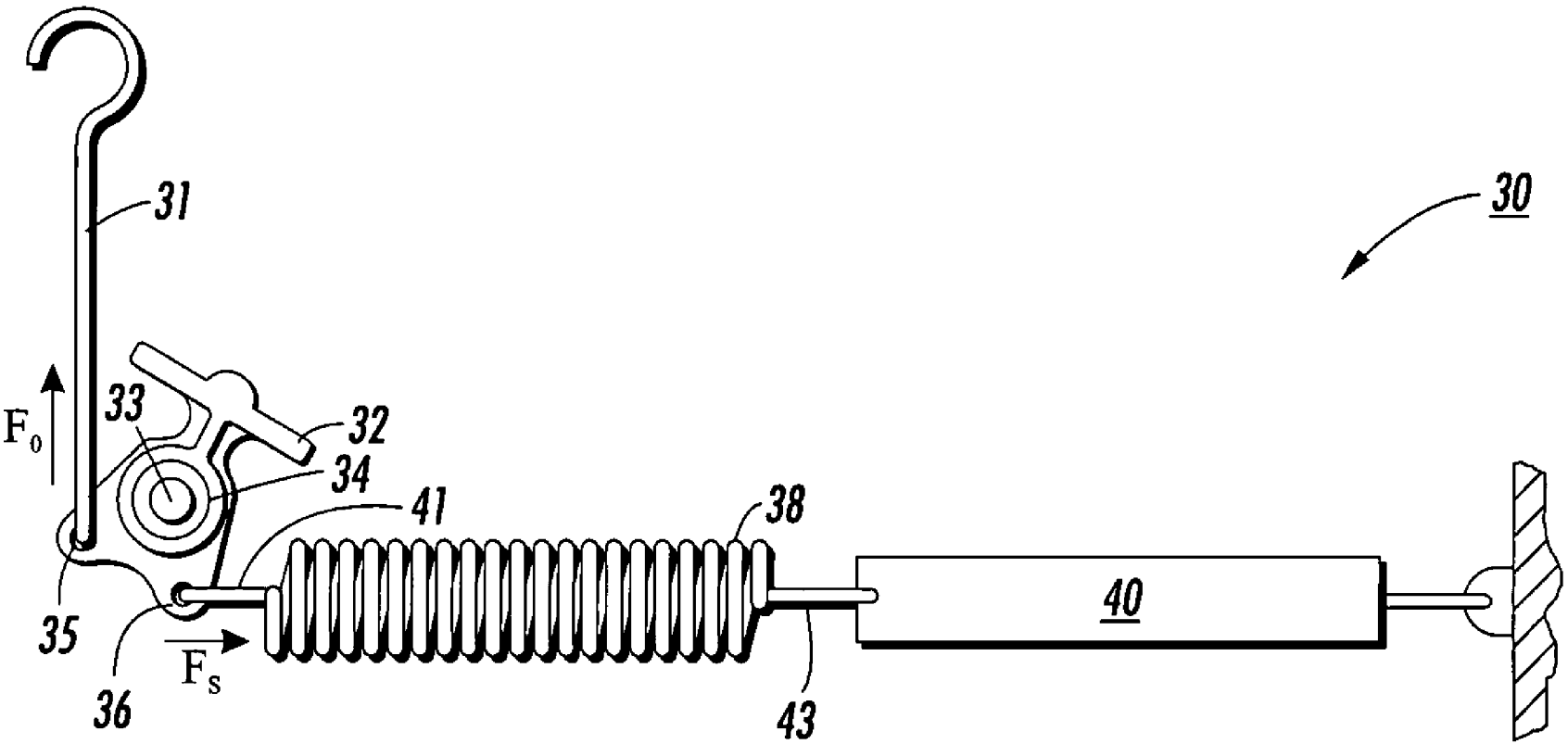
FIG. 4 is an elevational view of a portion of a load force module incorporating an embodiment of an aspect of the present invention.

FIG. 4 illustrates an embodiment of the load mechanism 30. The load mechanism applies the load force $F_0$ to the load attachment point on the distal end F of the load arm 23 via a load connector 31. One end of the load connector 31 engages the distal end F of the load arm 23 (FIGS. 2 and 3). In an embodiment, the end of the load connector 31 has a hook for engaging the load arm to transfer the load force $F_0$ from the load mechanism 30 to the transfix mechanism 9.

As the load arm 23 (FIGS. 2 and 3) pivots about its proximal end A when the transfix mechanism is engaged, the distal end F of the load arm is displaced substantially vertically against the load force $F_0$ applied by the load mechanism. Such displacement moves the load connector 31 in a substantially linear, substantially longitudinal direction. The load connector is attached to a crank 32 at connector attachment 35. A load spring 38 is also connected to the crank 32 at spring attachment 36. A spring hook 41 provides the attachment for the spring. The spring 38 applies a spring force $F_S$ to the crank at the spring attachment 36. In an embodiment, the spring is tensioned so that the spring force $F_S$ is a tension force. The spring force $F_S$ creates a moment (torque) in the crank about the crank pivot 33. The crank 32 transfers that spring force $F_S$ to the load connector 31. The geometry of the crank is used to compensate for changes in the spring force due to changes in the spring. An embodiment is described in which the spring is an extension spring such that the spring force $F_S$ is a tension force that increases as the length of the spring increases. However, the principles described can be applied to embodiments with compression or other types of springs.

Figure 5:
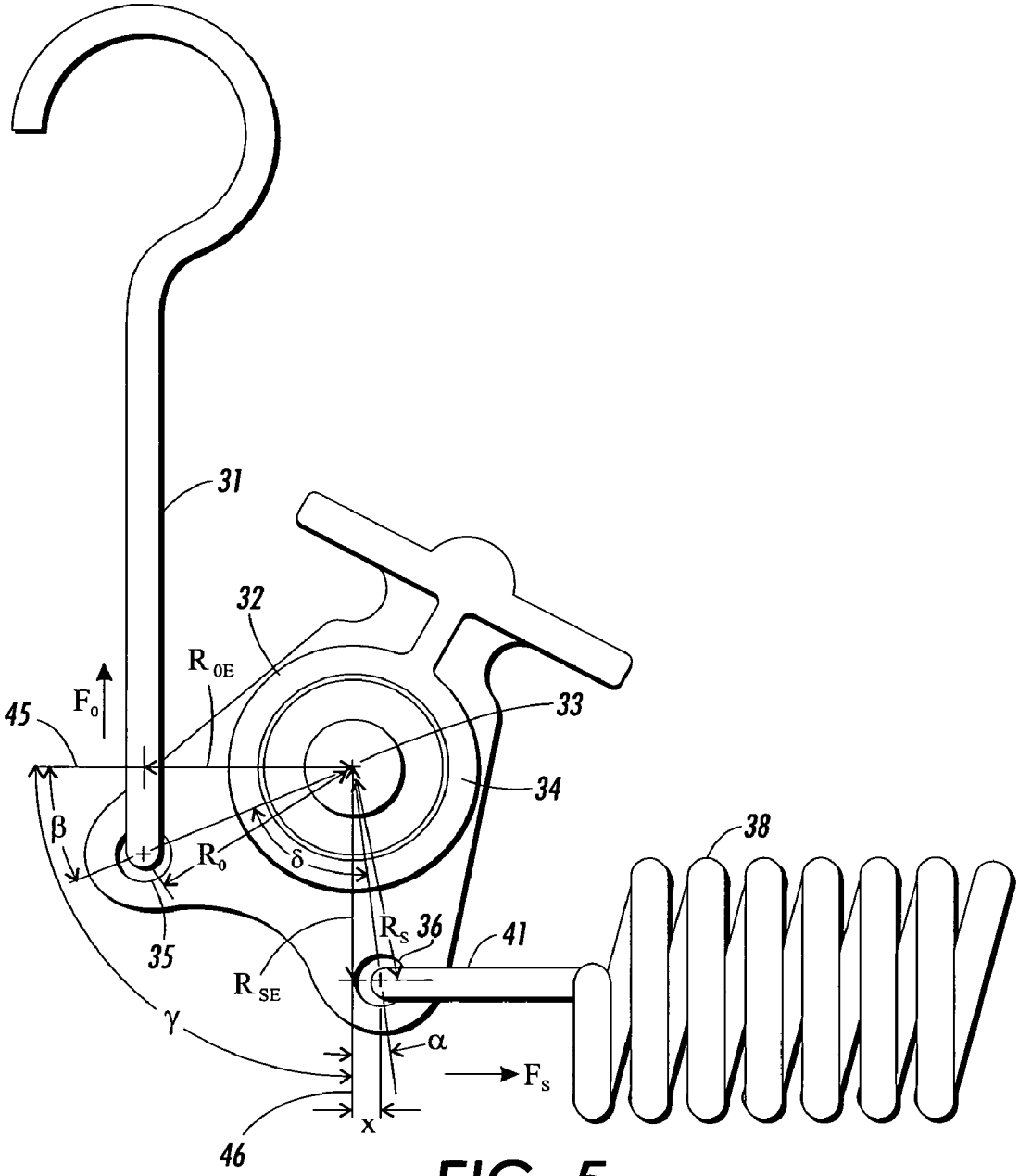
FIG. 5 is an enlarged view of a portion of the force module of FIG. 4.

Referring to the enlarged view of FIG. 5, in an embodiment, the crank 32 is arranged so that a relationship exists between the connector attachment 35 and the spring attachment 36 to ensure appropriate transfer of the spring force generated by the spring 38 to the load connector 31. For example, one embodiment of the crank 32 is rotatable about a crank pivot 33. The crank rotates on a crank bearing 34. The connector attachment 35 and the spring attachment 36 are positioned at connector attachment radius $R_0$ and spring attachment radius $R_S$, respectively, from the crank pivot 33. A spring attachment angle $\alpha$ is between the spring attachment radius $R_S$ and a spring effective radius $R_{SE}$, which is perpendicular to the line of movement of the spring attachment 36 and extending through the crank pivot. A connector attachment angle β is between the connector attachment radius $R_0$ and a connector effective radius $R_{0E}$, which is perpendicular to line of movement of the connector attachment 35 and extends through the crank pivot. The spring effective radius $R_{SE}$ (46) and the connector effective radius $R_{0E}$ (45) are separated by an action separation angle γ. In an embodiment, the action separation angle γ is 90°, with the spring 38 and the load connector 31 oriented at a right angle. However, other action separation angle γ values can be used. For example, an "in-line" crank is configured with an action separation angle of 0° so that the spring and the load connector are oriented in substantially the same direction. In another example, the load mechanism may include an action separation angle of 180°. The crank's connector attachment radius $R_0$ and spring attachment radius $R_S$ are separated from one another by a crank attachment angle δ.

The arrangement of the connector and spring attachments governs the relationship between the spring force $F_S$ and the load force $F_0$. The connector and spring attachments are arranged on the crank so that as the torque applied to the crank changes over relatively small angles of rotation, the load force $F_0$ does not change appreciably. This arrangement reduces the effect on the load force $F_0$ of variations in the spring force as the length of the spring 38 changes.

The spring force $F_S$ is a function of the spring preload force $F_{PL}$, the amount of longitudinal deflection X of the spring due to rotation of the crank, and the spring rate k. The spring preload force is the spring tension exerted by the spring 38 on the crank when the spring attachment angle α between spring attachment radius and spring effective radius line 46 perpendicular to the spring 38 is 0°. The longitudinal deflection of the spring is related to the longitudinal movement of the load connector by the geometry of the crank. The sum of the torque moments on the crank is zero. Thus, in one embodiment:

$$\sum M = F_S R_S \cos\alpha - F_0 R_0 \cos\beta = 0$$

$$F_S R_S \cos\alpha = F_0 R_0 \cos\beta$$

$$F_0 = F_S \frac{R_S \cos\alpha}{R_0 \cos(\beta)}$$

$$F_S = F_{PL} + kX$$

$$X = -R_S \sin\alpha$$

$$F_S = F_{PL} - kR_S \sin\alpha$$

$$\beta = \gamma + \alpha - \delta$$

In that arrangement, the crank establishes a relationship for the load force $F_0$ that can be expressed as follows:

$$F_0 = [F_{PL} - kR_S \sin\alpha] \frac{R_S \cos\alpha}{R_0 \cos(\gamma + \alpha - \delta)}$$

wherein $F_{PL}$=pre-load force on the spring 38 when the spring attachment angle α is 0°;

k=spring rate of the spring 38;

$R_S$=spring attachment radius from the pivot 33 to the spring attachment 36;

$R_0$=connector attachment radius from the pivot 33 to the connector attachment 35;

δ=crank attachment angle between the spring attachment radius $R_S$ and the connector attachment radius $R_0$;

α=Spring attachment angle between spring attachment radius and the spring effective radius $R_{SE}$ line 46 (perpendicular to spring 38);

β=Connector attachment angle between connector attachment radius $R_0$ and the connector effective radius $R_{0E}$ line 45 (perpendicular to load connector 31); and γ=Action separation angle between the spring effective radius $R_{SE}$ and connector effective radius $R_{0E}$.

Setting the crank attachment angle δ until the load force $F_0$ is nearly constant for small spring attachment deflection angles α provides minimal variation to the transfix force applied by the transfix roller, regardless of the deflection of the load arm 23 caused by the thickness of the medium 12. In a particular embodiment, the connector attachment radius $R_0$ and the spring attachment radius $R_S$ are the same length, and are both 12 mm. However, in other embodiments, the connector and spring attachment radii can be different from each other. In a particular embodiment, the crank attachment angle δ is approximately 70°. A nominal connector attachment angle β when the load arm 23 is against the frame stop G (FIG. 2) may be 27°. A nominal spring attachment angle α when the load arm 23 is against the frame stop G (FIG. 2) may be 7°. In an embodiment, the spring 38 imparts a spring force of approximately 30 pounds.

As the transfix mechanism causes the transfix roller 20 to engage the media 12 on the drum 10 (FIG. 3), the distal end F of the load arm 23 is displaced, causing the load connector 31 to move longitudinally (vertically). The longitudinal movement of the load connector rotates the crank about its pivot against the tension force of the spring 38. In an embodiment, as the load connector attachment angle β is reduced, the spring attachment angle α changes from a relatively small angle toward 0°, and then to a relatively small angle on the opposite side of 0°. Thus, for most of the range of movement, the spring attachment angle is smaller than the load connector attachment angle. The geometry of one exemplary embodiment of the transfix mechanism and the load mechanism causes the crank to rotate for maximum media thickness (maximum deflection of the load arm 23) until the connector attachment angle β is approximately 0°.

Therefore, the geometry of the crank is designed so that as the spring force increases, the output force $F_0$ on the load connectors 31 does not change significantly. The crank geometry compensates for the spring rate of the springs so that the output force $F_0$ is substantially the same regardless of the angle of the crank 32 for small angle changes (generally less than approximately 30°). Variations in media thickness and transfix mechanism manufacture result in different loaded extensions of the load connector 31 and, therefore, different extensions of the springs 38. The compensation geometry of the crank 32 ensures that the resulting transfix load will be substantially the same regardless of such variations.

The torque applied to the crank by the spring 38 is a function of the spring force $F_S$ and the effective spring force radius $R_{SE}$ between the pivot 33 and the spring force line of action. The balancing torque applied to the crank by the load connector 31 is a function of load force $F_0$ and the connector effective radius $R_{0E}$ between the crank pivot 33 and the connector line of action. As the crank rotates, the connector effective radius $R_{0E}$ changes. Referring, for example, to the configuration shown in FIG. 5, as the load connector 31 moves in response to displacement of the load arm 23 shown in FIGS. 2 and 3, the crank rotates clockwise, which in turn extends the spring 38. As the spring 38 lengthens, the spring force $F_S$ increases, creating greater torque on the crank. The torque applied by the load connector 31 balances the torque due to the spring force $F_S$. However, as the crank rotates so that the connector attachment angle β decreases, the connector effective radius $R_{0E}$ increases. Therefore, the magnitude of the load force $F_0$ needed to create the balancing load torque on the crank need not increase if the geometry of the crank is properly set to provide an connector effective radius that changes at a rate appropriate to the change in the spring force as the crank rotates. In embodiments, the spring attachment angle α remains small as the crank rotates through its normal range of movement, so that the spring effective radius does not vary much.

The relative lengths of the spring effective radius and the load connector effective radius and/or the relative magnitudes of the action separation angle γ and the crank attachment angle δ determine how to compensate for changes in the spring force due to changes in the spring geometry (length). In an example, a difference in the magnitude of the action separation angle γ and the crank attachment angle δ are different to provide compensation for a change in the spring force as the spring length changes. In a particular example, if the action separation angle γ is larger than the crank attachment angle δ, the crank can be arranged so that the connector effective radius varies in a direction that permits at least some compensation for an increasing spring force as the spring lengthens.

Referring again to FIG. 4, the end of the spring 38 not attached to the crank may be attached to a fixed anchor, such as a frame portion. A tension adjustment mechanism, such as a turnbuckle 40, is preferably included to adjust the preload force $F_{PL}$ on the spring 38. A second spring hook 43 attaches the spring to the turnbuckle.

Figure 6:
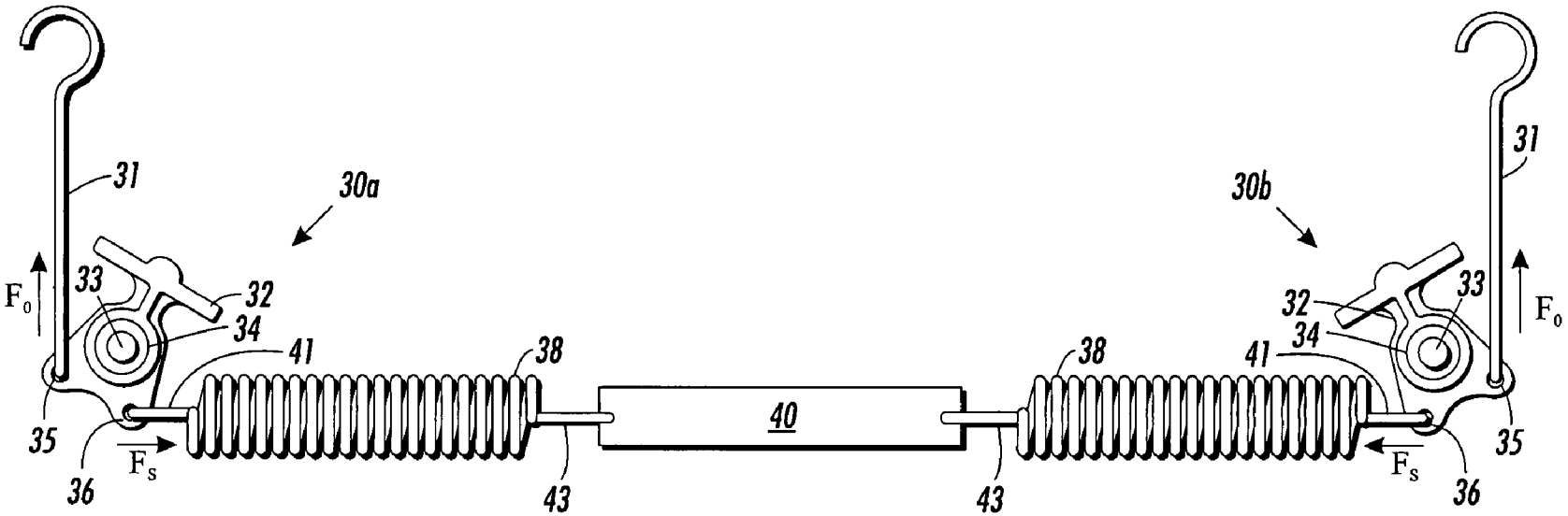
FIG. 6 is an elevational view of a portion of a load force module incorporating another embodiment of an aspect of the present invention.

In another embodiment, illustrated in FIG. 6, two load mechanisms 30*a*, 30*b* are attached to one another. The arrangement illustrated in FIG. 6 provides a balanced force to the opposite ends of the transfix roller 20 (FIG. 3) without the need to separately adjust each load mechanism. The two load connectors 31 of such a bilateral load mechanism are connected to identical cranks and springs. A common tension adjuster, such as the turnbuckle 40, attached to both springs 38 of the load mechanisms allows simultaneous and balanced adjustment of the load mechanisms. In other embodiments, the tension adjuster could be attached on one side of a single spring or a plurality of springs connected in series. The complete bilateral load mechanism extends across the width of the transfix roller, and has two load connectors 31. Each load connector applies the load force to a corresponding load arm 23 of substantially identical transfix mechanisms at each end of the transfix roller.

In one embodiment, the ability of the cranks to transfer spring force from vertical to horizontal allows the springs 38 to be installed in a horizontal orientation. Since the two springs 38 point toward each other in the horizontal orientation, they can be fastened to one another via the turnbuckle 40 and spring hooks 43. This configuration eliminates the need for attachment points in the printer case or the printer chassis for the springs. Other embodiments could employ one long spring in place of two short springs, with the turnbuckle 40 on one side of the spring. The horizontal orientation of the springs 38 is advantageous because it places the springs 38 in an area of the printer where there is plenty of room for them. Embodiments have been described in which the spring 38 is an extension spring. Other embodiments may incorporate a compression spring, or other types of springs.

Figure 7:
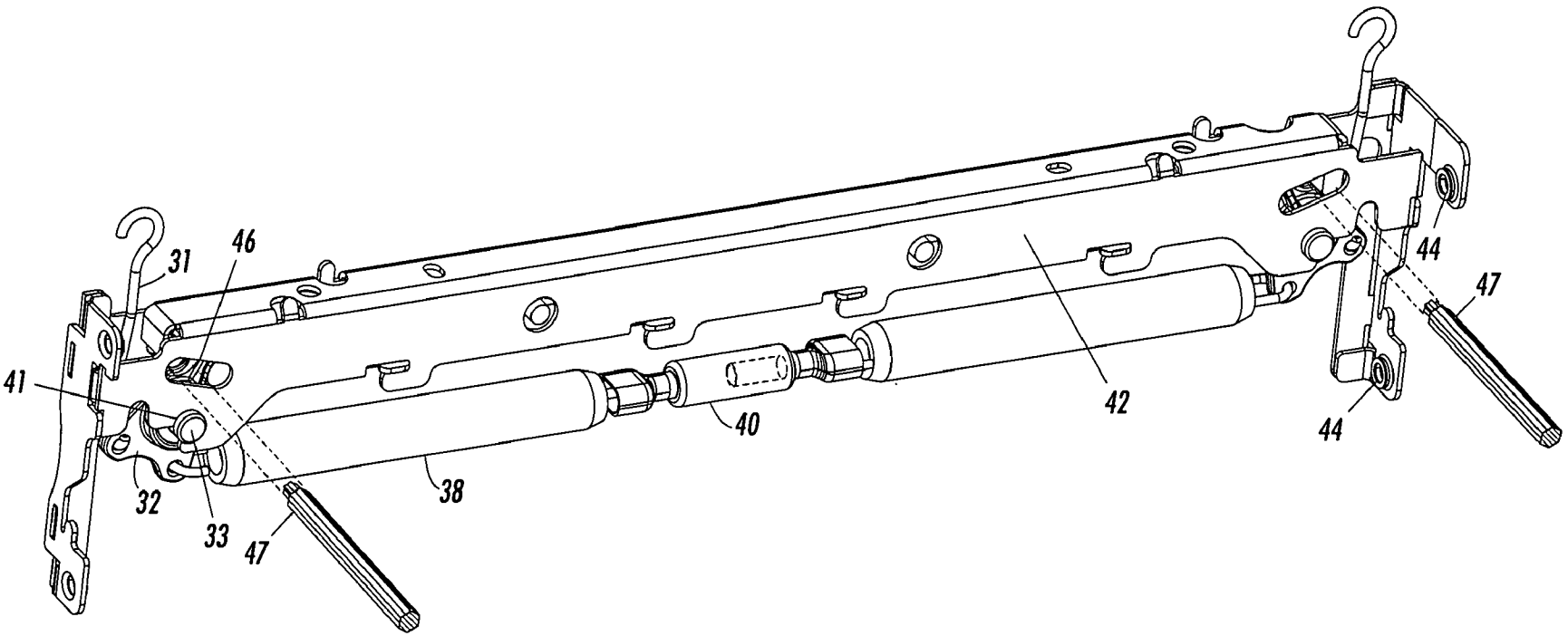
FIG. 7 is a perspective view of another embodiment of a load force module, together with a mounting frame, incorporating an aspect of the present invention.

The load mechanism of embodiments is a self-contained assembly that can be built, tested and calibrated independent of the printer or other device into which it is to be installed. The assembled, tested, and calibrated load mechanism can then be fastened to the printer as a single unit. The load connectors 31 may or may not be part of the self-contained assembly. An exemplary self-contained load mechanism assembly is shown in FIG. 7. The pivots 33 of each crank 32 are fitted into pivot receptacles 41 on a load mechanism frame 42, and secured in place so that the pivot 33 does not move relative to the load mechanism frame. The turnbuckle 40 can be adjusted for the proper load force $F_0$ on the two load connectors 31 with the load mechanism secured to the load mechanism frame. The entire load mechanism assembly is attached to the printer chassis inside the printer housing. For example, attachment devices such as screws or bolts can be inserted through load mechanism assembly attachment holes 44. Such mounting of the load mechanism in the printer does not change the adjustments and calibration of the load force generated by the load mechanism.

Figure 8:
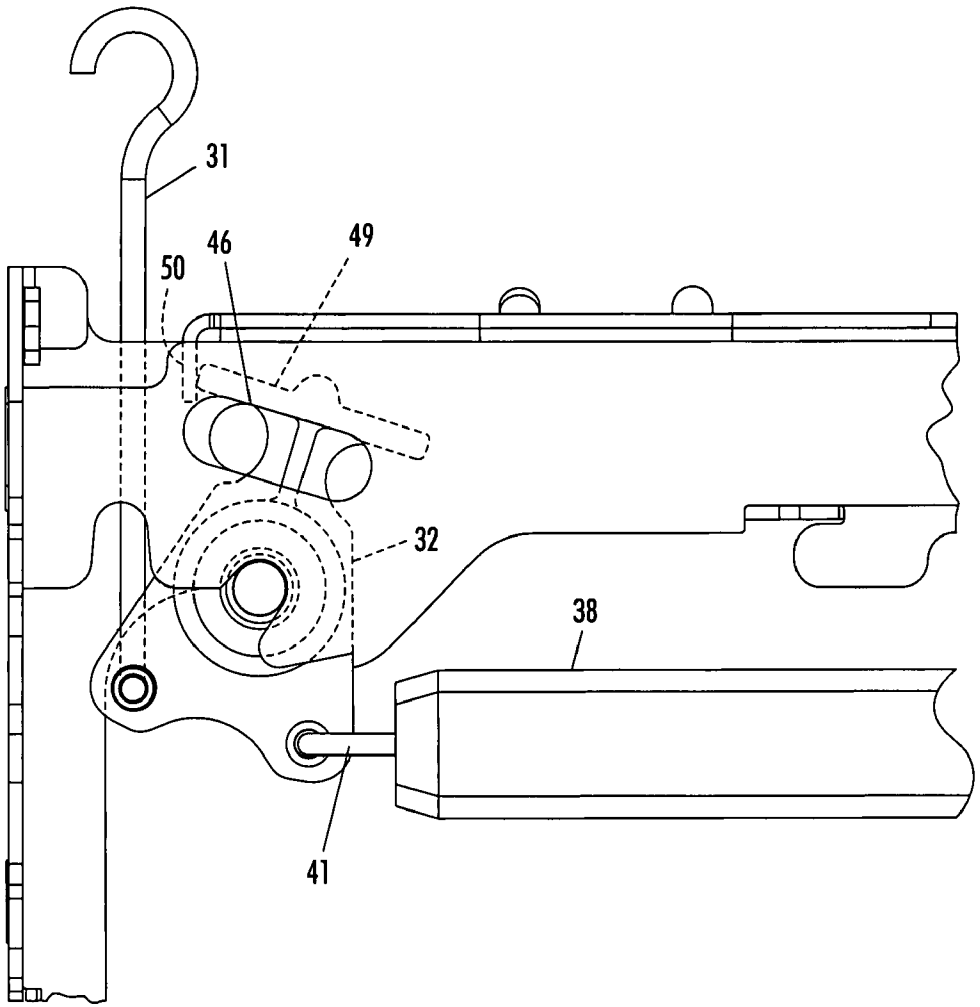
FIG. 8 is an enlarged view of a portion of a load force module incorporating an aspect of the present invention.

Load assembly mounting tool holes 46 in the load mechanism frame permit mounting tools to position the load connectors on the ends of the load arms 23 after the load assembly has been assembled into the printer. Referring to FIG. 8, the spring 38 rotates the crank 32 counterclockwise until one arm 49 of the T-shaped extension of the crank 32 abuts a hard stop, such as a tab 50 portion of the load mechanism frame. For example, the mounting tool holes 46 may be elongated so that a mounting tool 47 having an elongated tip, such as a TORX-head driver bit, can be inserted into the mounting tool hole. To attach the load connector 31 onto the distal end F of the load arm, the hook end of the load connector must be raised. The mounting tool is inserted into the mounting tool hole 46, where it contacts the crank 32. Within the elongate mounting tool hole, the mounting tool can then rotate the crank 32 clockwise, against the force of the spring 38, to raise the load connectors. A TORX-20 driver or similar tool can be used for such rotation of the crank. The elongated mounting tool hole may be oriented at an acute angle with respect to the orientation of the load mechanism assembly to improve the contact between the mounting tool and the crank through the range of rotation.

The detailed description provided above describes particular embodiments and includes details that can be varied without departing from the spirit and principles of the invention. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

We claim:

1. A load mechanism for applying a load force, the load mechanism comprising:

a crank having a crank pivot;

a spring attached to the crank at a spring attachment;

a load connector attached to the crank at a load connector attachment;

wherein the load connector has a load connector direction of action relative to the crank;

wherein the load connector direction of action has a load connector effective radius extending perpendicular to the load connector direction of action from the crank pivot to the load connector direction of action;

wherein longitudinal movement of the load connector causes rotational movement of the crank about the crank pivot;

wherein rotational movement of the crank changes the length of the spring;

wherein the spring has a spring direction of action relative to the crank;

wherein the spring direction of action has a spring effective radius extending perpendicular to the spring direction of action from the crank pivot to the spring direction of action; and wherein as the crank rotates in a first rotational direction over a predetermined rotational movement of the crank, the length of both the load connector effective radius and the spring effective radius change, and the change in the length of the load connector effective radius is different from the change in the length of the spring effective radius.

2. The load mechanism of claim 1, wherein the length of the spring effective radius and the length of the load connector effective radius change in different directions over at least a portion of the predetermined rotational movement.

3. The load mechanism of claim 2, wherein over a first portion of the predetermined rotational movement, the length of the spring effective radius decreases and the length of the load connector effective radius increases.

4. The load mechanism of claim 3, wherein:

over a second portion of the predetermined rotational movement, the length of the spring effective radius and the length of the load connector effective radius change in the same direction; and over the second portion of the predetermined rotational movement, the length of the spring effective radius changes less than the length of the load connector effective radius as the crank rotates in the first rotational direction over at least a portion of the predetermined rotational movement.

5. The load mechanism of claim 1, wherein the length of the spring effective radius changes less than the length of the load connector effective radius as the crank rotates in the first rotational direction over at least a portion of the predetermined rotational movement.

6. The load mechanism of claim 5, wherein:

the spring attachment and the load connector attachment are separated by an attachment angle;

the spring effective radius and the load connector effective radius are separated by an action separation angle; and the magnitude of the action separation angle is different from the magnitude of the attachment angle.

7. The load mechanism of claim 6, wherein the magnitude of the action separation angle is larger than the magnitude of the attachment angle.

8. The load mechanism of claim 1, additionally comprising a spring adjuster for adjusting the spring force of the spring at the spring attachment.

9. The load mechanism of claim 1, wherein:

a connector attachment radius extends between the crank pivot and the connector attachment;

a spring attachment radius extends between the crank pivot and the spring attachment; and the connector attachment radius and the spring attachment radius are substantially the same length.

10. The load mechanism of claim 1, additionally comprising a receptacle for receiving a tool to rotate the crank to cause longitudinal movement of the load connector.

11. A load mechanism for applying a load force, the load mechanism comprising:

a crank having a crank pivot;

a spring attached to the crank at a spring attachment and having a spring direction of action relative to the crank;

wherein the spring direction of action has a spring effective radius extending perpendicular to the spring direction of action from the crank pivot to the spring direction of action;

a load connector attached to the crank at a load connector attachment at a substantially fixed radius from said crank pivot, said load connector having a load connector direction of action relative to the crank such that longitudinal movement of the load connector along said direction of action causes rotational movement of the crank about the crank pivot;

wherein the load connector direction of action passes through said load connector attachment and has a load connector effective radius extending perpendicular to the load connector direction of action from the crank pivot to the load connector direction of action;

wherein rotational movement of the crank changes the length of the spring; and wherein as the crank rotates in a first rotational direction over a predetermined rotational movement of the crank, the length of the load connector effective radius changes differently than the length of the spring effective radius.

12. The load mechanism of claim 11, wherein as the crank rotates in the first rotational direction over the predetermined rotational movement of the crank, the length of both the load connector effective radius and the spring effective radius change.

13. The load mechanism of claim 11, wherein the length of the spring effective radius and the length of the load connector effective radius change in different directions over at least a portion of the predetermined rotational movement.

14. The load mechanism of claim 13, wherein over a first portion of the predetermined rotational movement, the length of the spring effective radius decreases and the length of the load connector effective radius increases.

15. The load mechanism of claim 14, wherein:

over a second portion of the predetermined rotational movement, the length of the spring effective radius and the length of the load connector effective radius change in the same direction; and over the second portion of the predetermined rotational movement, the length of the spring effective radius changes less than the length of the load connector effective radius as the crank rotates in the first rotational direction over at least a portion of the predetermined rotational movement.

16. The load mechanism of claim 11, wherein the length of the spring effective radius changes less than the length of the load connector effective radius as the crank rotates in the first rotational direction over at least a portion of the predetermined rotational movement.

17. The load mechanism of claim 11, wherein:

the spring attachment and the load connector attachment are separated by an attachment angle;

the spring effective radius and the load connector effective radius are separated by an action separation angle; and the magnitude of the action separation angle is different from the magnitude of the attachment angle.

18. The load mechanism of claim 17, wherein the magnitude of the action separation angle is larger than the magnitude of the attachment angle.

19. The load mechanism of claim 11, wherein the radius of the connector attachment is substantially the same length as the radius of the spring attachment.

* * * * *